US005307053A

United States Patent [19]

Wills et al.

[11] Patent Number: 5,307,053

[45] Date of Patent: Apr. 26, 1994

[54] DEVICE AND METHOD FOR ALERTING HUNTERS

[75] Inventors: George W. Wills, Smyrna; Phillip R. Wills, Alpharetta, both of Ga.

[73] Assignee: Lucile A. Wills, Abbeville, Ala.

[21] Appl. No.: 887,295

[22] Filed: May 22, 1992

[51] Int. Cl.[5] ..... G08B 21/00

[52] U.S. Cl. ..... 340/573; 42/1.01; 42/106; 340/539; 340/540; 340/825.36

[58] Field of Search ..... 340/573, 539, 540, 825.49, 340/825.36; 342/125; 42/1.01, 70.01, 106

[56] References Cited

U.S. PATENT DOCUMENTS

| | | | |
|---|---|---|---|
| 3,400,393 | 9/1968 | Ash | 42/106 |
| 4,785,291 | 11/1988 | Hawthorne | 340/573 |
| 4,833,452 | 5/1989 | Currier | 340/539 |
| 4,849,735 | 7/1989 | Kirtley et al. | 340/539 |
| 4,853,692 | 8/1989 | Wolk et al. | 340/573 |
| 4,899,135 | 2/1990 | Ghahariiran | 340/573 |
| 4,924,211 | 5/1990 | Davies | 340/573 |
| 5,086,290 | 2/1992 | Murray et al. | 340/573 |
| 5,183,951 | 2/1993 | Bilodeau | 42/1.01 |

*Primary Examiner*—Glen R. Swann, III

*Attorney, Agent, or Firm*—Hopkins & Thomas

[57] ABSTRACT

A hunter alert device (9) for use by hunters when hunting wild game consists of transmitter means (21), receiver means (22), an antenna (11), a transceiver controller (20), and an indicator means (12). The device (9) operates by intermittently transmitting a modulated radio frequency signal through antenna (11) and listening for radio frequency signals transmitting from alert devices worn by other hunters. When a signal is detected, the receiver means (22) determines whether the signal is within a predetermined range of the hunter and, if so, activates the indicator means (12) to warn the hunter.

15 Claims, 4 Drawing Sheets

DEVICE AND METHOD FOR ALERTING HUNTERS

FIELD OF THE INVENTION

This invention relates generally to safety devices and, more particularly, to a radio frequency safety device for alerting a wild game hunter to the presence of other hunters.

BACKGROUND OF THE INVENTION

Each year, an alarming number of wild game hunters are accidentally shot by other hunters due to mistaken identity, poor visibility, or mere carelessness. For example, in November 1991, a father and his son, along with three of their friends, were hunting white-tail deer in New York State. When the hunting party spotted their first deer, the hunters split up to encircle the deer. Minutes later, the father fired a shot and ran towards the prey. When the other hunters arrived, they discovered the father lying over his son's body crying. The father had shot his own son through the head, killing him instantly. Friends later surmised either that a deer had run between the father and his son, or that the father mistook his son's white and black cap for a white tail deer.

These types of tragic hunting accidents, and others, are sometimes referred to as hunter judgment accidents. Unfortunately, the potential for such accidents can be greatly increased by the very tactics employed by hunters to evade detection by their prey. For example, it is common for hunters to don highly camouflaged clothing, which can render them extremely difficult to detect by other hunters. This fact, coupled with the cautions and stealth movements of hunters, can lead to hunters being mistaken by other hunters for the prey being hunted. In addition, the increasing popularity of wild game hunting and the increased density of hunters in popular hunting areas also contributes to the number of hunter judgment accidents that occur each year.

Some techniques to reduce the incidents of hunter judgment accidents have been proposed and implemented in recent years. One such technique has been embodied in hats, vests, and other hunting apparel that are dyed hunter orange and worn by hunters in the field. Hunter orange is a bright fluorescent color that is easy for the human eye to detect, yet undetectable by colorblind game animals such as deer, elk, and related species. In theory, all hunters wear a hunters orange vest or cap such that each hunter is easily distinguishable from wild game.

Although studies show that the use of hunter orange has dramatically reduced the number of deer hunting two-party hunter judgment accidents, these type of shootings still occur. While hunter orange can be used effectively when hunting deer, their related species, and other color-blind animals, there is a major shortcoming with hunter orange that significantly contributes to the continued cases of two-party hunter judgment accidents. Hunter orange is only effective when it can be seen by other hunters within range of their weapons. Therefore, the effectiveness of hunter orange can be totally negated by the contours of the land, dense vegetation and other terrain features. In addition, the fact that some hunters refuse to wear the hunter orange clothing can aggravate the problem since movements of non-wearers might more easily be confused as being those of prey rather than hunter.

Hunter orange can not be used effectively with all types of game hunting because some game, in particular the wild turkey, can actually distinguish color and, therefore, detect the presence of a hunter wearing hunter orange. The restoration efforts of wildlife agencies have been so phenomenally successful that today most states have wild turkey hunting seasons. This has caused a resurgence in the popularity of turkey hunting to the point that presently, according to some surveys, it is the fastest growing hunting sport and, if the trend continues, could soon have as many participants as does deer hunting. This presents a real safety problem because studies already indicate that of all forms of game hunting, wild turkey hunting is the most dangerous for the potential of two-party shooting accidents.

Accordingly, a persistent and heretofore unaddressed need exists for a reliable method and enabling device adapted to alert a hunter to the presence of other hunters within range of his weapon without detracting from the effectiveness of traditional camouflage techniques and without alerting game with keen senses to the presence of hunters. It is to the provision of such a method and device that the present invention is primarily directed.

SUMMARY OF THE INVENTION

Briefly described, the present invention is an unobtrusive hunter safety system comprising a method and apparatus adapted to alert a hunter to the presence of other hunters within a given range. The system comprises an electronic hunter alert device to be worn or carried by all hunters within a given hunting area. Each hunter alert device includes a transmitter for sending a signal, such as an electromagnetic signal, to be received by the hunter alert devices worn or carried by other hunters, a receiver for detecting the electromagnetic signals transmitted by the hunter alert devices of other hunters while the other hunters are within a predetermined range of the device, and an indicator responsive to the detection of an electromagnetic signal by the receiver for warning each hunter of the presence of another hunter or hunters within the predetermined range.

In a preferred embodiment of the present invention, the transmitter comprises a radio transmitter for sending a modulated, preferably digitally encoded radio signal in an omni-directional pattern. The receiver comprises a receiver circuit for demodulating radio signals that are within the frequency band of the transmitter. An alternating switch is provided for automatically switching the device between transmission and reception modes.

The receiver is adapted to determine whether the signals received are being transmitted from other hunters who are within the predetermined range. For wild game hunting, the predetermined range preferably is approximately one hundred yards, the range within which most two-party accidents occur.

The indicator may comprise any of a variety of means for creating a perceptible indication that a radio signal is being received, yet which are imperceptible by the hunted game. For example, an indication means may comprise an array of light emitting elements, an audio transducer for transmitting a tone through an earphone, or a vibrating element coupled to the body of the hunter to provide a tactile indication. In this manner, the hunter alert device can operate in a way that, unlike orange colored clothing, does not affect the hunt or become negated by the terrain, thus creating the potential for a safer hunting environment and widespread acceptance of the system.

The hunter alert device of this invention further includes a control means having a microprocessor for modulating and demodulating the digitally encoded radio signals sent by the device and received from like devices. The microprocessor is programmed to encode transmitted radio signals with identification data and decode detected encoded radio signals from like devices. Each control means is provided with a unique identification code that is encoded into transmitted signals to allow for the identification by other alert devices of the hunter associated with a particular detected signal. Preferably a Liquid Crystal Display (LCD) is provided for relaying this identification data to the hunter.

The identification data encoded into the transmitted signals allows each hunter to determine whether a detected signal is that of a known hunter or an unknown hunter. This information is helpful in the situation where one hunter can see another known hunter, or is hunting with a friend or buddy, and an unknown hunter moves within the predetermined range. Alerted to the presence of either a known or unknown hunter within the predetermined range, the hunter can exercise increased caution before firing his weapon.

If three hunters move within the predetermined range of each other, the receiver of each device relays this information to the indicator, which thereby informs each hunter that two other hunters are presently within range. When one of the two hunters moves back out of range, the indicator provides this information to each hunter as well.

During operation, as a hunter or a group of hunters venture separately off into a hunting area, each is provided with a hunter alert device. As the hunters move about the hunting terrain, each of their alert devices transmits a unique encoded signal. The transmission occurs for a split second, and then the alternating switch switches the device into the reception mode whereby the receiver listens for the signals from other hunters. When one hunter moves within the predetermined range of another hunter, the alert device of each hunter receives the encoded signal from the alert device of the other hunter, and their respective indicators are activated. Preferably, the hunter alert devices are worn on the hunters' wrists or are mounted onto their weapons so that if a hunter fails to notice an activated indicator such as an LED prior to aiming at his prey, the LED indicator will be in or immediately adjacent to the hunter's line of sight when the hunter attempts to aim and shoot his weapon.

Accordingly, it is an object of the present invention to provide hunters a means for detecting the presence of other hunters within a predetermined range.

Another object of the present invention is to provide hunters with a hunter detection means that provides an indication of the presence of other hunters that is imperceptible to and thus does not alert or spook the hunted game.

Another object of the invention is to provide hunters a means for reducing the occurrence of hunter judgment accidents.

Another object of the invention is to provide hunters with a hunter safety system that is unobtrusive and unencumbering.

Another object of the invention is to provide hunters with a hunter safety system that is inexpensive to manufacture, efficient in operation, and durable in structure.

Other objects, features, and advantages of the present invention will become apparent from the following specification when read in conjunction with the accompanying drawings.

DETAILED DESCRIPTION

Figure 1B:
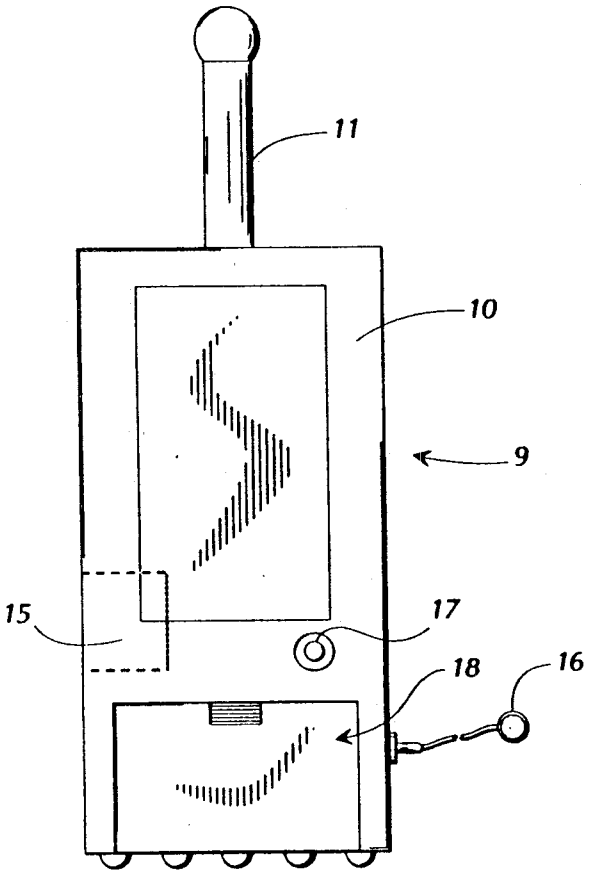
FIG. 1B is a bottom view of the underside of the hunter alert device of FIG. 1A.
Figure 1A:
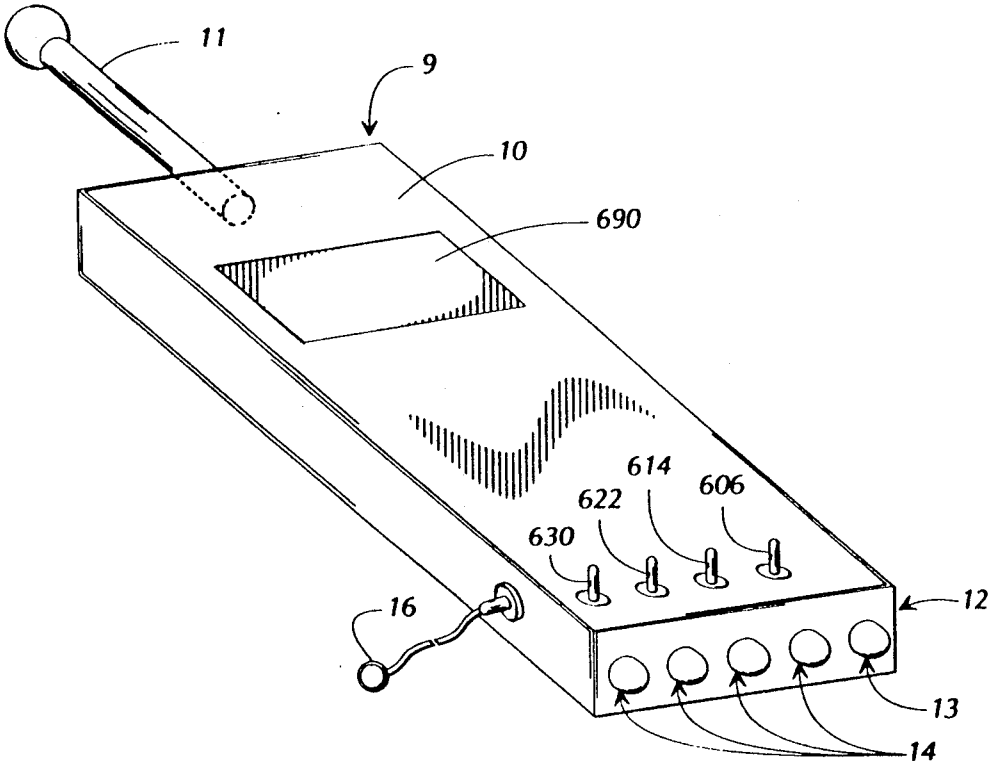
FIG. 1A is a front perspective view of the hunter alert device constructed in accordance with a preferred embodiment of the present invention.

Referring now in more detail to the drawings, in which like numerals refer to like parts throughout the several views, FIG. 1A is a perspective view of a hunter alert device 9 constructed in accordance with a preferred embodiment of the present invention. The hunter alert device 9 comprises a relatively small, generally rectangular housing 10, an antenna 11 for transmitting and receiving radio signals, and an indicator means 12 for signalling the hunter of the reception of a radio signal from a like hunter alert device carried by another hunter. Within housing 10, as described in detail hereinbelow, is a transceiver for modulating and demodulating the transmitted and received radio signals and a microprocessor for controlling the operation of the device. Although the radio frequency band is preferable for transmitting signals in hunting applications, many other frequency bands within the electromagnetic spectrum might also be chosen as well an non-electromagnetic transmissions such as ultrasonic acoustic signals.

The hunter alert device 9 preferably is adapted to attach to the wrist of the hunter or to the hunter's weapon so that upon aiming the weapon at a potential target, the indicator means 12 is readily visible to alert the hunter to the presence of another hunter in the vicinity. The indicator means 12 comprises a light emitting diode (LED) 13 and a colored warning LED array 14. The LED 13 is activated to indicate that the device is not receiving a signal from another alert device and that the power supply of the device is operable. The warning LED array 14 indicates that a radio frequency signal from another alert device within the predetermined range has been detected and thus that another hunter is present within a range that is predetermined and preset to correspond to the effective range of the type of weapon being used.

During operation, the transceiver of the hunter alert device 9 alternates between a transmit mode and a receive mode. When in the transmit mode, the transceiver transmits a radio signal in a specific frequency band. When in the receive mode, the transceiver "listens" for radio signal transmissions from the hunter alert devices worn by other hunters. If a valid signal is received from another safety device, the indicator means 12 illuminates a warning LED 14. Alternately, in circumstances where visual indication is not desirable, a vibrator element 15 may be used to provide a tactile warning to the hunter or a tone can be transmitted through an earphone 16, as an audible alert to the hunter. Obviously, a variety of methods may be used to alert the hunter with the suggested methods representing only preferred expedients.

Referring to FIG. 1B, there is provided a pressure activated on/off switch 17 located on the underneath side of the device 9. The pressure activated on/off switch is adapted to turn the device on upon application of the slightest amount of pressure against the switch. This ensures activation of the device upon attachment to the hunter or the hunter's weapon and prevents inadvertent failure to activate the device. The device is preferably powered by a standard battery located within battery compartment 18.

The housing 10 can be made from any of a number of rugged materials such as plastic that are impact and moisture resistant and that are capable of handling extreme temperatures. The housing 10 preferably is camouflaged since it will be outwardly visible. The hunter alert device 9 is permanently sealed, except for the battery compartment 18 to prevent tampering with the unit.

Figure 2:
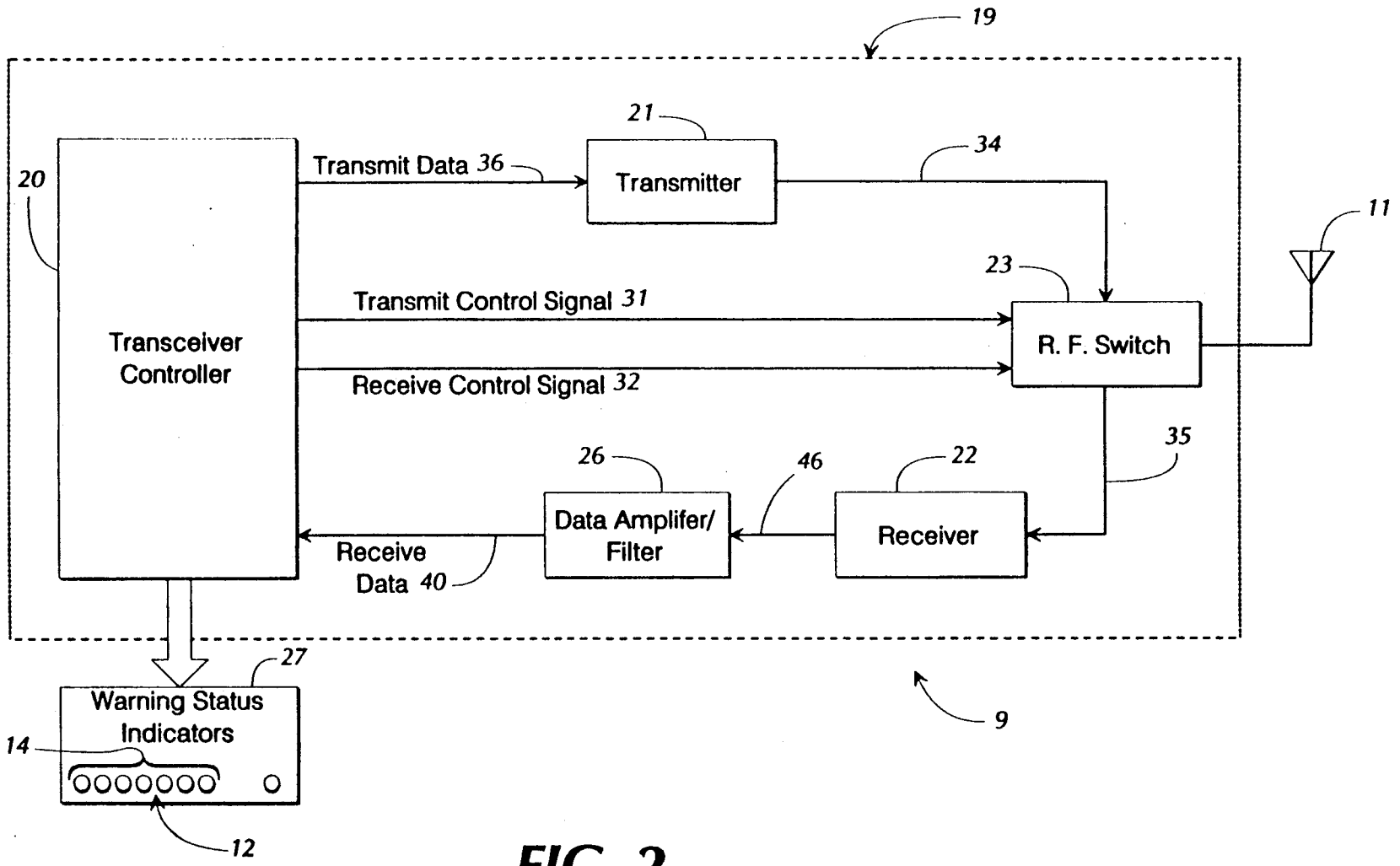
FIG. 2 is a functional block diagram of the hunter alert device of FIG. 1.

FIG. 2 is a functional block diagram showing a preferred embodiment of the hunter alert device of this invention. A transceiver 19 is mounted within the housing of the alert device 9. The transceiver 19 includes a transceiver controller 20 for controlling the operation of the hunter alert device 9, specifically, the operation of a transmitter 21 and a receiver 22. A radio frequency (R.F.) switch 23 alternately switches the alert device 9 from a transmission mode to a reception mode by controlling the signal transmissions to and from the antenna 11. A detected signal received through antenna 11 by receiver 22 is amplified and filtered through data amplifier/filter 26 and directed to the controller 20. A warning status indicator 27 includes the indicator means 12 for warning the hunter of the reception of a radio frequency signal. Shown in FIG. 2 for indicator means 12 is a warning LED 14.

The transmit and receive duration of the device 9 is controlled by the transceiver controller 20. A transmit control signal 31 and a receive control signal 32 are sent by the transceiver controller 20 to the R.F. switch 23 to cause the switch to switch modes and allow either the transmission signal 34 from the transmitter 21 to be transmitted through the antenna 11 or the reception signal 35 from the antenna 11 to be received by the receiver 22.

When in the transmit mode, the alert device transmits a pulse modulated radio frequency signal. A transmit data signal 36 from the microprocessor alternates between a logic 0 and a logic 1 to control the pulse amplitude modulation of the transmitter 21. The modulation technique may alternately be continuous wave amplitude modulation (AM), frequency modulation (FM), phase modulation, or any other convenient modulation method. To switch the device into a transmission mode, the transceiver controller 20 commands the transmit control signal 31 to a logic 0, enabling the modulated R.F. transmission signal 34 from transmitter 21 to be transmitted through the R.F. switch 23 to the antenna 11. The transceiver controller 20 then generates an encoded binary message and outputs it to the transmit data line 36 to modulate the output of the transmitter 21. The encoded binary message preferably contains an identification number and a conventional error detecting code that has previously been programmed into each transceiver controller.

To switch into the receive mode, the transceiver controller 20 commands the receive control signal 32 to a 0 logic level, which commands the R.F. switch 23 to allow signals from the antenna 11 to be sent to the receiver 22. The receiver 22 demodulates the signals that are in-band with the transmitter's output and conform to its modulation method. The output of the receiver 22 is amplified, filtered, and converted to a digital logic level signal by the data amplifier/filter 26. The receive threshold amplitude of the data amplifier/filter 26 is set so that only signals transmitted from another device that is within a predetermined alerting range will be recognized. Signals transmitted from another device beyond the alert range will not be recognized. In this way, only devices within a predetermined range are recognized and cause an alert signal to the hunter.

The predetermined range established by the receive threshold amplitude preferably is selected to correspond to the "injury zone" within which the majority of hunter judgment accidents occur plus an added safety band to serve as a "buffer warning zone" to prevent a hunter from entering the above defined "injury zone" For example, in hunting wild deer or wild turkey, the pre-determined range should be set at approximately 100 yards since this distance is outside the range of a shotgun and beyond the range within which the majority of hunter judgment accidents involving rifles occur.

The transmit mode duration preferably is less than a tenth of a second, and the transceiver controller 20 preferably is programmed to switch to a transmit mode approximately every four seconds, although other timing schemes may be employed within the scope of this invention.

Demodulated data received by the device causes the receive data signal 40 to switch between a logic 1 level and a logic 0 level corresponding to modulated 1's and 0's in the signal being received. When an in-range signal is detected by the data amplifier/filter 26, a receive data signal 40 goes to a logic 1 level. The pulse amplitude modulated received signal causes the receive data signal to alternate between a logic 1 (signal present) and a logic 0 (no signal present). The transceiver controller 20 receives and decodes the demodulated data and checks to see whether the data received conforms to the correct data format and that the error detection code is correct. If the data received is in the correct format, the transceiver controller 20 stores the identification number in RAM and activates the warning status indicator 27.

The warning status indicator 27, whether it be an LED, a vibrating element, or an earphone, will remain activated as long as the transceiver 19 continues to receive an identification number at least once during a preselected interval, which, preferably, is about 30 seconds. If the transceiver 19 does not receive a signal encoded with a currently active identification number at least once during the 30 second interval, the transceiver controller 20 deactivates the warning status indicator 27 to indicate that the hunter corresponding to that signal has moved out of range. The transceiver controller 20 can detect and store multiple identification numbers and activate multiple warning indicators corresponding to the number of identification numbers received during each 30 second interval. In this manner, the transceiver 19 can alert the hunter as to the number of hunters within the predetermined range as well as their respective movements in and out of range.

Another in-range frequency source such as a nearby radio station or ham radio may sometimes "jam" the receiver 22 making impossible the reception of in-range demodulated data. When this happens, the transceiver controller 20 detects that the receive data signal 40 has switched to a logic 1 but that no data, or invalid data, is being received. The controller 20 then alerts the hunter to the jamming condition by activating the warning status indicator 27 in intermittent one second pulses for an entire 30 second interval or until the transceiver 19 receives a valid demodulated signal, whichever occurs first. This pulsed on/off signaling of the warning status indicator 27 indicates to the hunter that the device is being jammed and, therefore, may not currently be reliable to detect the signals from other hunters, devices.

Figure 3:
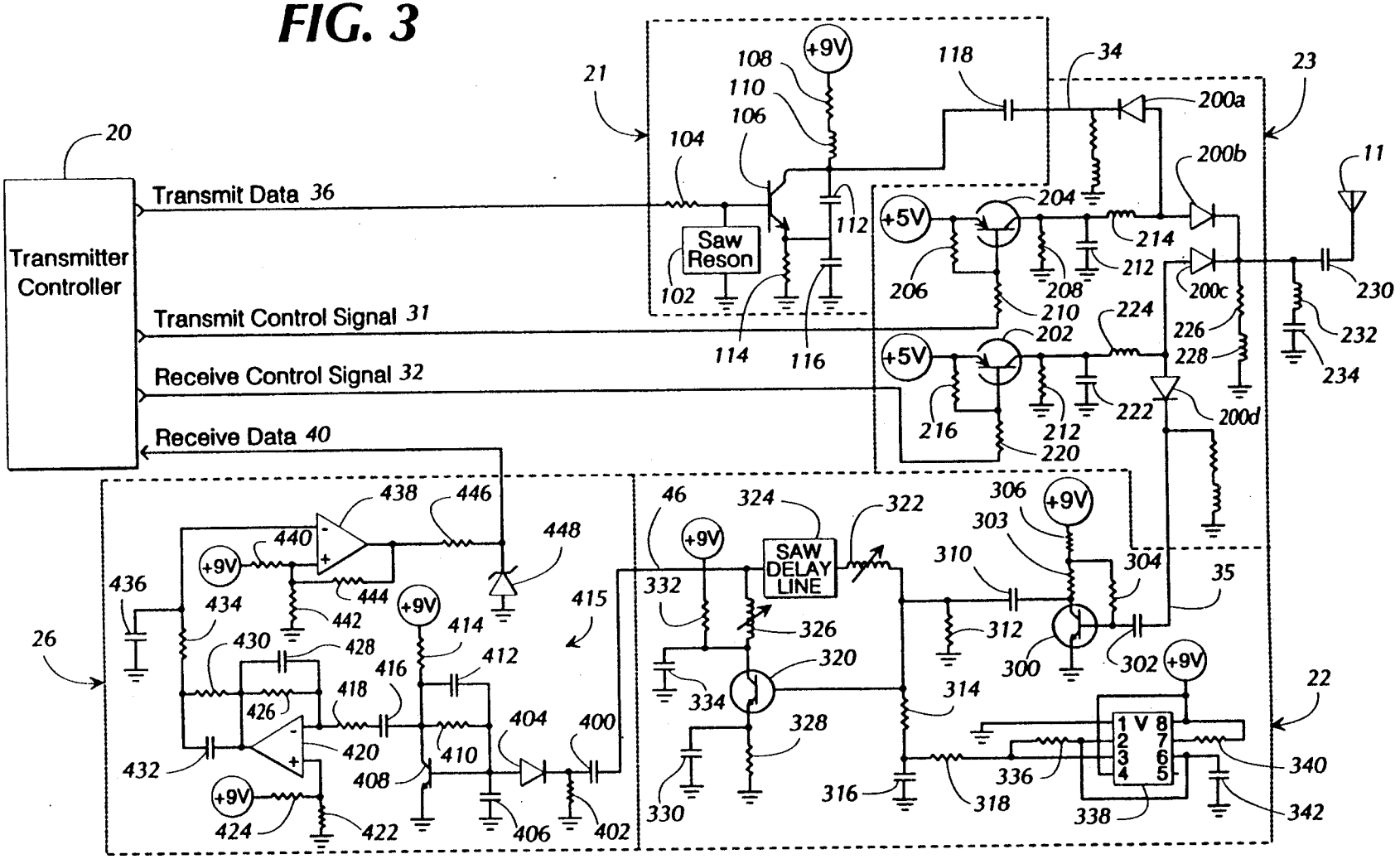
FIG. 3 is an electronic schematic diagram of a preferred circuit for implementing the present invention.

FIG. 3 is a electronic schematic diagram of a preferred embodiment of the circuitry for implementing the transmitter 21, receiver 22, and R.F. Switch 23 of this invention. The transmitter 21 in this embodiment is a surface acoustic wave (SAW) resonator pulse amplitude modulated signal generator. This circuit configuration is preferable because of its low power consumption, frequency stability, relatively small physical size, and low cost. Although other types of transmitter modulation techniques provide better signal to noise performance (e.g., frequency shift keying, phase shift keying, frequency hoping, direct sequence spread spectrum, etc.), the pulse amplitude modulation transmitter illustrated in FIG. 3 was selected because it simplifies the receiver design while providing adequate signal to noise characteristics for this particular application.

The transmitter's carrier frequency is determined by the SAW resonator 102. SAW resonators typically are commercially available in UHF frequencies from approximately 224 MHz to approximately 928 MHz. The SAW resonator 102 is activated by applying approximately five volts to the transmit data line 36. When the SAW resonator 102 is turned on it acts as a continuous wave (CW) UHF signal source. When the transmit data line 36 is at approximately 0 volts, the SAW resonator 102 is turned off and no signal is generated. Hence, pulse amplitude modulation is accomplished by alternately applying five volts (logic 1) and 0 volts (logic 0) to the transmit data line 36. The components 106, 108, 110, 112, 114, 116 and 118 will be understood by those skilled in the art to be configured as a conventional transistor based buffer/amplifier circuit.

The output signal strength of the transmitter 21 is carefully set so that each hunter safety device radiates approximately the same signal strength so that each device is detected by another device at approximately the same range. The signal radiated from the antenna 11 conforms with FCC regulations for unlicensed operation. The SAW resonator 102 preferably is chosen to have a frequency between 902 MHz and 928 MHz due to the fact that the FCC allows greater signal strength radiation in this band. Since hunters may approach one another from any direction the antenna 11 is configured to emit signals in an omni-directional pattern.

The transmit/receive R.F. switch 23 will be seen to be a conventional pin diode R.F. switch. The four-pin diode components 200*a*, 200*b*, 200*c* and 200*d* control the direction in which signals are allowed to pass through the switch. When these components are forward biased with sufficient current, they allow R.F. signals to be passed through with little attenuation. When no forward bias current is applied to the devices, they provide a high attenuation to the R.F. signals. During the device's transmission mode, the transceiver controller 20 applies approximately five volts to the receive control signal line 32, turning off transistor 202, and applies approximately 0 volts to the transmit control signal line 31, turning on transistor 204. When transistor 204 is on, it supplies current for forward biasing the pin diodes 200*a* and 200*b*, thereby allowing the transmission signal 34 to be coupled into the antenna 11. Alternately, when in the receive mode, the transceiver controller 20 applies 0 volts to the receive control signal line 32, turning on transistor 202, and five volts to the transmit control signal line 31, turning off transistor 204. When transistor 202 is on, it supplies current for forward biasing the pin diodes 200*c* and 200*d*, thereby allowing R.F. signals from the antenna 11 to be coupled into the receiver 22.

The receiver 22 will be understood by those skilled in the art as a conventional super-regenerative receiver circuit such that a detailed discussion of the circuit itself is not necessary here. A detailed theory of operation for this circuit can be found in a paper titled "A Low Cost Super-regenerative SAW Stabilized Receiver" by Darrell Ash; published in the IEEE Transactions on Consumer Electronics, August 1987, Volume CE-33, No. 3 (ISSN 0098-3063), pp. 395-404. This circuit is disclosed in U.S. Pat. No. 4,749,964 of Ash.

In operation of the receiver 22, a received R.F. signal 35 is amplified by a transistor 300, which is configured as a conventional amplifier. The regenerative circuit, comprising elements 312, 320, 322, 324, 326, 328, 330, 332 and 334 uses a SAW delay line 324 and a common emitter amplifier 320 to provide the R.F. oscillator. An external quenching circuit, comprising elements 314, 316, 318, 336, 338, 340 and 342, is used to provide greater dynamic range than is attainable with a self quenched configuration. Components 336, 340 and 342 determine the quenching frequency.

The receiver output signal 46 of the receiver 22 is input to the data amplifier/filter 26 wherein the demodulated signal is detected and conditioned for processing by the transceiver controller 20. The components 400, 402, 404, 406, 408, 410, 412 and 414 are configured as a diode detector 415 and filter circuit. The output of the diode detector and filter circuit is input to an operational amplifier 420 configured as a low pass filter. The components 416, 418, 422, 424, 426, and 428 determine the filter characteristics of the low pass filter. The output of the low pass filter 420 is input to a passive filtering network 430, 432, 434, and 436. The output of the passive filter network is input to an operational amplifier 438 configured as a comparator with hysteresis. The components 440, 442, and 444 control the trip point and hysteresis of the comparator. The comparator 438 converts the demodulated data into a square wave and eliminates high frequency noise during output transitions. The output of the comparator 438 is converted to 5 volt logic levels by the resistor 446 and zener diode 448.

The receiver 22 and the sensitivity of the diode detector 415 is pre-set so that the transceiver will detect signals generated from a similar transceiver within the predetermined range, allowing for typical path loss conditions, which limit the range resolution of this transceiver configuration. In addition, terrain and foliage characteristics may cause greater alert range variations than can be tolerated for some applications. If path loss variations result in a large variation in the alert range determination, then other ranging techniques, such as pulsed time of flight, may be employed. However, the adoption of other ranging techniques adds complexity and cost to the transceiver and should only be used when necessary.

Figure 4:
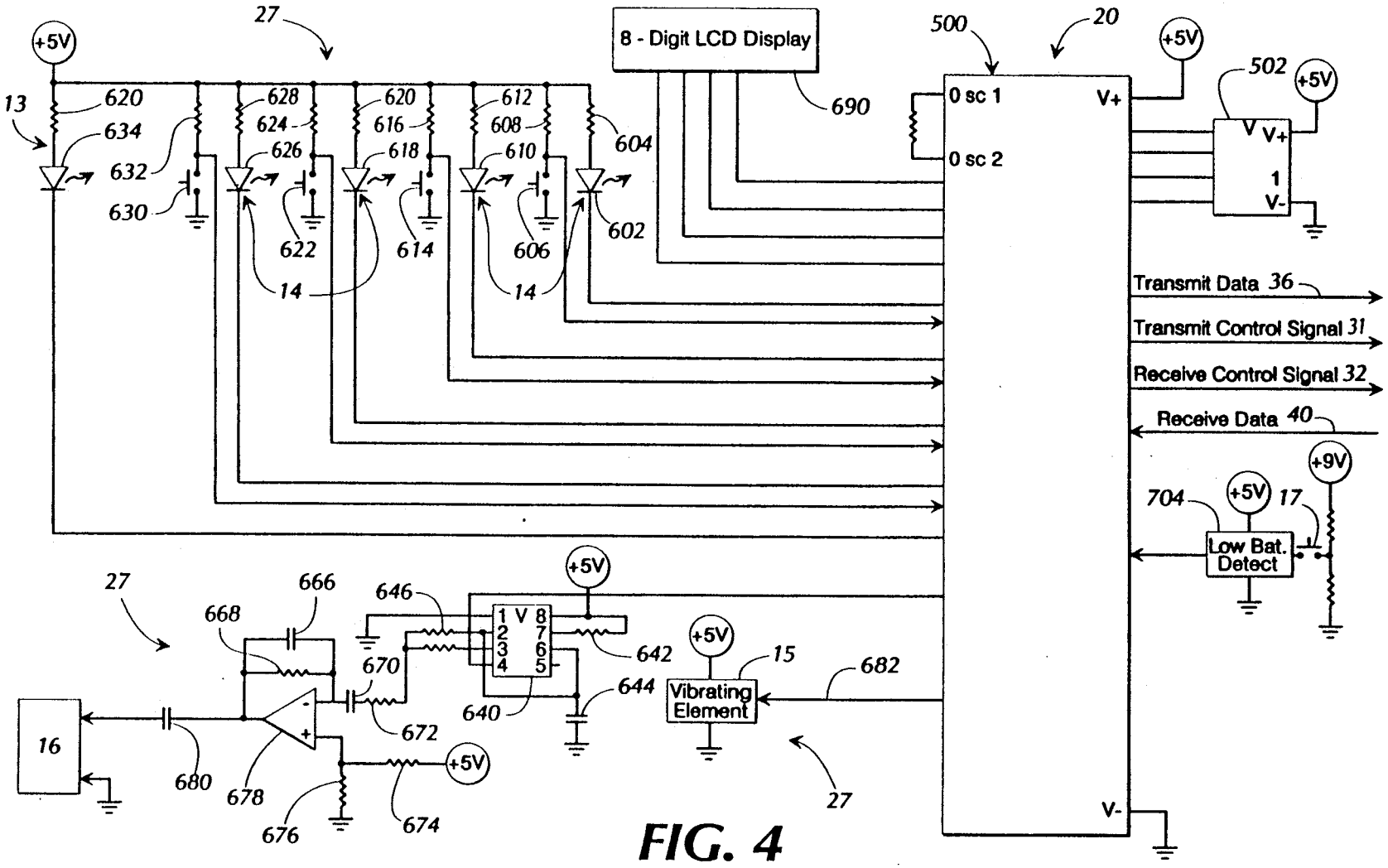
FIG. 4 is an electronic schematic diagram of a preferred circuit for implementing the transceiver controller and warning status functions of the hunter alert device of FIG. 2.

Shown in FIG. 4 is an electronic schematic diagram of the transceiver controller 20 and warning status indicators 27. The transceiver controller 20 uses a microprocessor 500 to control all of the transceiver's modes of operation. A Motorola 68HC05P4 microprocessor, which is commercially available, has been determined to perform satisfactorily for this application. An electrically erasable and programmable read only memory (EEPROM) 502 is used to store a factory set 8 digit identification number. The identification number is stored as eight, four bit binary coded decimal (BCD) digits. This allows 4,294,967,296 unique identification numbers to be used so that all hunter devices can be assigned a unique identification number.

The warning status indicator 27, comprising LED 13 and LED array 14, includes light emitting diodes 602, 610, 618, 626 and 634. Alternatively, a vibrating element 15, or an earphone 16 comprising a tone generator 640–680, could be used to replace or augment LED array 14. Although only four light emitting diodes (LED's) are shown in this embodiment, it will be understood that any number of such devices could be incorporated into the device, so that greater or less than four in-range hunters can be detected simultaneously. The microprocessor 500 turns on the LED's by commanding the appropriate control line to a logic 0. The vibrating element 15 is turned on when the microprocessor 500 commands the vibrator-on-line 682 to a logic 1. The earphone tone generator is turned on when the microprocessor 500 commands the reset input pin 4 of the 555 timer I.C. 640 to a logic 1. When activated, the 555 timer I.C. 640 generates an audio frequency square wave. The components 642, 644 and 646 determine the audio frequency, which preferably is set to about 500 Hertz to be easily heard by a hunter. This square wave is then filtered by the bandpass filter 666–680 so that the signal output to the earphone jack 16 is approximately a 500 Hertz sine wave.

Upon depression of the on/off switch 17, power is applied to the microprocessor 500, which then executes a power-on reset and begins executing its program. The microprocessor 20 first executes a self test routine whereby it determines if the transmitter 21, receiver 22, R.F. switch 23, and data amplifier 26 are functioning properly. The microprocessor commands both the transmit control signal 31 and receive control signal 32 to a zero logic level. This allows the transmission signal 34 to be coupled through the R.F. switch 23 to the receiver 22. The microprocessor 500 reads its identification number from the EEPROM 502, and formats and transmits a message encoded with its own identification number through the transmit data line 36. The microprocessor 500 checks to see that the message it received from the data amplifier/filter 26 is the same message that it transmitted. If the transceiver 19 passes the self-test, the microprocessor 500 momentarily activates each of the warning status indicators 27. This self-test mode allows the majority of components in the transceiver to be tested.

After executing a successful self-test, the microprocessor 500 turns on LED 13 by activating LED 634 and enters the transmit mode. The illumination of LED 634 indicates that no warning condition has been detected. In the transmit mode, the receive control signal 32 is commanded to a 1 logic level and the transmit control signal 31 is commanded to a logic 0. The microprocessor 500 then reads its identification number from the EEPROM 502, generates a transmit message, and outputs the message to the transmit data line 36. The transmitted message contains an 8 digit BCD identification number and an 8 bit checksum for error detection. The transmit message is output to the transmit data line 36 at approximately 1000 bits per second in a Manchester phase encoded format. The transmit mode is repeated approximately every 4 seconds.

After the microprocessor 500 completes its transmit message, it goes into the receive mode and stays in this mode until the next transmit cycle. In the receive mode the receive control signal 32 is set to a 0 logic level and the transmit control signal 31 is set to a 1 logic level. The receive data input 40 is then monitored for any signal detected by the receiver 22. If a signal is detected, the microprocessor 500 checks to see if the signal conforms to a valid message format. If it does, the microprocessor 500 stores the received identification number in its RAM, turns off the LED 634, and activates the warning status indicator 27, such as by turning on the LED 602, the vibrating element 15, or the earphone tone generator 640–680.

The warning status indicator 27 will remain activated as long as the signal with this identification number is received at least once every 30 seconds. Once the signal corresponding with this identification number has not been received for 30 seconds the microprocessor deactivates the warning status indicator 27 and turns on LED 634. SPST switches 606, 614, 622, and 630, as shown in FIGS. 1A and 4, are provided for each LED 602, 610, 618, and 626. When the user presses an SPST switch, the microprocessor turns off the tone generator 640 and vibrating element 15 and momentarily displays the identification number of the signal received on a liquid crystal display (LCD) 690.

If multiple signals are received, each having a different identification number, the microprocessor 500 turns on successive LED's 610, 618, 626, etc. Each time a new identification number is received, the same sequence of activating the warning status indicator 27 and displaying the identification number in the LCD 690 is repeated as above. This allows hunters to identify continuously the hunters they know from the hunters they do not know and to detect multiple hunters venturing within the predetermined alert range.

If the microprocessor 500 detects that the receive data signal 40 switches to a logic 1 and no data, or invalid data, is received, it alerts the hunter by flashing LED 634 and activating the warning status indicator 27 in an on and off manner (approximately 1 second on and 1 second off) for an entire 30 second interval or until a valid signal is received, whichever occurs first. This warning method indicates when the receiver may be jammed by other R.F. sources nearby and, therefore, may not be able to detect another transceiver within the predetermined alert range.

A standard 9 or 6 volt battery preferably is used to power the transceiver. The 5 volt supply is generated using a conventional 5 volt regulator integrated circuit (IC). A low battery detector IC 704 is used to detect when the 9 or 6 volt battery voltage is too low for proper operation of the R.F. portion of the transceiver. The microprocessor 500 detects when the output of the low battery detector 704 indicates a low battery condition and begins flashing the LED 634. The LED 634 will be flashed for 1 minute before the microprocessor 500 turns on all of the warning status indicators 27 and executes a HALT instruction. The microprocessor stays in this mode until the power is cycled off and on and a good battery status indication is detected from the low battery detector 504. This allows a hunter to determine when his battery is too low for proper operation and allows him to replace it with a fresh one.

The features and principles of the present invention have been illustrated in the foregoing description of a preferred embodiment thereof. It will be apparent to these skilled in the art that numerous additions, deletions, and modifications may be made to the illustrated embodiment without departing from the spirit and scope of the invention as set forth in the claims hereof.

We claim:

1. A safety device adapted to be carried by a hunter when hunting game to detect the presence of other hunters carrying like devices and to alert the other hunters of the presence of the hunter within a predetermined range, said device comprising:

transmitter means for transmitting a signal to be received by like devices carried by the other hunters, said transmitter means including means for modulating the transmitted signal to encode the transmitted signal with identification data;

receiver means for detecting signals transmitted from like devices carried by the other hunters while the other hunters are within the predetermined range, including means for decoding encoded signals; and indicator means responsive to the detection of the signal transmitted from like devices for warning the hunter of the presence of the other hunters within the predetermined range, said indicator means being adapted to warm the hunter in a manner that is imperceptible to the hunted game.

2. The device of claim 1, wherein the identification data is unique for said safety device.

3. The device of claim 2, wherein said indicator means can display the identification data of the detected encoded signals.

4. The device of claim 1, wherein said means for modulating the transmitted signal includes a microprocessor and an EEPROM.

5. The device of claim 1, wherein said indicator means includes identification data indication means for providing a perceptible indication of the identification data decoded by said receiver means whereby the hunter can determine whether the detected signal is that of a known hunter or an unknown hunter.

6. The device of claim 1 and further comprising switch means for alternately switching said device from a transmitting mode to a receiving mode.

7. The device of claim 1, wherein said indicator means includes a visual indication means for providing a perceptible visual indication of the presence of another hunter within the predetermined range.

8. The device of claim 7, wherein said visual indication means comprises multiple visual indicators to indicate the number of detected encoded signals being received from other like devices.

9. The device of claim 1, wherein said indicator means includes an audio indication means for providing a perceptible audible indication of the presence of another hunter within the predetermined range.

10. The device of claim 1, wherein said indicator means includes a tactile indication means for providing a perceptible indication of the presence of the other hunters within the predetermined range.

11. The device of claim 1, wherein said transmitter means is adapted to transmit electromagnetic signals within the radio frequency band.

12. The device of claim 1, wherein said transmitter means is adapted to transmit electromagnetic signals in an omni-directional pattern.

13. The device of claim 1, wherein said indicator means is adapted to produce acoustic signals.

14. A hunter safety system for use by hunters when hunting game to detect the presence of other hunters within a predetermined range and to alert the other hunters of a hunter's presence within the predetermine range, said system comprising:

a hunter alert device to be carried by each hunter while hunting game in an area potentially having other hunters, each of said hunter alert devices including:

transmitter means for sending a radio signal encoded with identification data for identifying a hunter in an omni-directional pattern to be received by like hunter alert devices carried by the other hunters;

receiver means for detecting the radio signal sent by like hunter alert devices carried by the other hunters while the other hunters are within the predetermined range; and indicator means responsive to the detection of the radio signal by the receiver means for warning the hunter of the presence of the other hunter within the predetermined range, said indicator means adapted tow arm the hunter in a manner imperceptible to the hunted game.

15. A method for detecting the presence of hunters within a predetermined range of each other while the hunters hunt for game, said method comprising the steps of:

transmitting an electromagnetic signal from each hunter in an omni-directional pattern to be received by the other hunters;

receiving the transmitted electromagnetic signals from the other hunters while the other hunters are within the predetermined range;

pulse modulating the electromagnetic signal to encode identification data for identifying a hunter associated with the electromagnetic signal; and indicating to each hunter upon reception of the electromagnetic signal that another hunter is within the predetermined range, said indicating step adapted to be performed in a manner that is imperceptible to the hunted game.

* * * * *